United States Patent [19]

Wyner et al.

[11] 4,333,032

[45] Jun. 1, 1982

[54] HIGH PRESSURE SODIUM LAMP CONTAINING BARIUM GETTER

[75] Inventors: Elliot F. Wyner, Peabody; John J. Gutta, Salem, both of Mass.; Richard A. Parrott, Merrimack, N.H.

[73] Assignee: GTE Products Corporation, Stamford, Conn.

[21] Appl. No.: 945,671

[22] Filed: Sep. 25, 1978

[51] Int. Cl.[3] ..... H01J 19/70; H01J 61/24

[52] U.S. Cl. ..... 313/181; 316/24

[58] Field of Search ..... 313/181, 25

[56] References Cited

U.S. PATENT DOCUMENTS 3,519,864 7/1970 Gungle et al. ..... 313/25

3,753,018 8/1973 Beijer et al. ..... 313/25

3,780,331 12/1973 Knochel et al. ..... 313/219

3,882,346 5/1973 McVey ..... 313/25

4,025,812 5/1977 McVey ..... 313/176

*Primary Examiner*—Robert Segal

*Attorney, Agent, or Firm*—James Theodosopoulos

[57] ABSTRACT

A high pressure sodium lamp comprises an elongated arc tube within an evacuated outer jacket, the arc tube containing a fill including sodium and mercury. A barium getter film is disposed on the inner jacket wall at one end thereof. The film is longitudinally spaced more than 1 cm away from the end of the arc tube in order to reduce photoelectron emission from the barium which can cause sodium migration from the arc tube.

7 Claims, 1 Drawing Figure

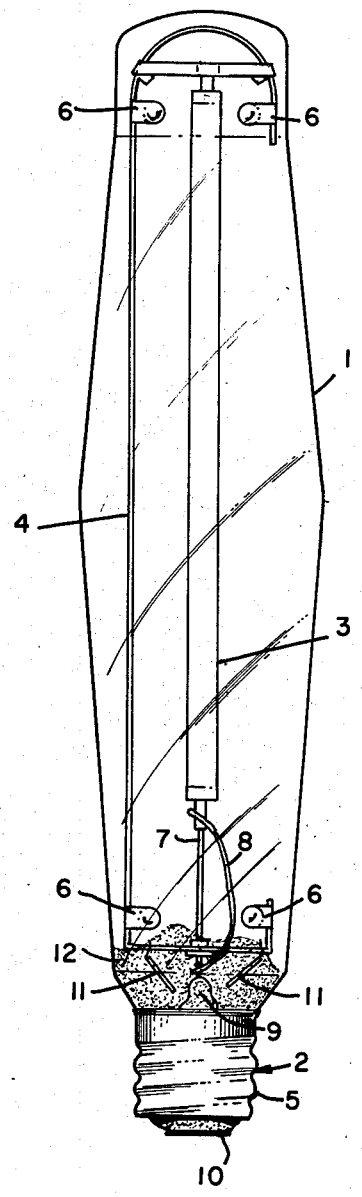
6
6
1
4
3
7
8
6
6
12
11
11
9
2
5
10

HIGH PRESSURE SODIUM LAMP CONTAINING BARIUM GETTER

THE INVENTION

This invention is concerned with high pressure sodium lamps. Such lamps comprise an elongated ceramic arc tube within a glass jacket, the arc tube containing sodium and mercury plus a starting gas. The jacket is at a vacuum to conserve heat, and employs a getter, usually barium, to maintain the vacuum, as discussed in U.S. Pat. No. 4,025,812, at column 1, lines 29–40.

A problem in such lamps is caused by photoelectron emission from the arc tube supporting frame which results in sodium depletion within the arc tube and which shortens the life of the lamps. This is discussed in U.S. Pat. No. 3,780,331. The solution disclosed therein is to use nonphotoelectron-emitting materials for the supporting frame, to interpose a photoelectron collector between the lead-in conductor frame and the arc tube, and to place an insulator over the support frame.

We have found that the barium getter flash is another even more dominant source of photoelectron emission that can shorten the life of the lamp and this invention is concerned with substantially eliminating said flash as a source of photoelectron emission. This is accomplished by flashing the barium getter so that the barium film, which comprises the visible barium flashed deposit as well as the invisible barium splash on the envelope, is more than 1 cm from the horizontal plane at the lower end of the vertical arc tube that is perpendicular to the arc tube. The reason for keeping the barium film more than 1 cm away is that any photoelectrons emitted therefrom would, during normal lamp operation, be attracted to the lead-in wire, for example, lead-in wire 7 in the drawing, instead of to the arc tube; sodium depletion results from attraction of the photoelectrons to the arc tube.

The drawing is an elevational view of a high pressure sodium lamp in accordance with this invention.

As shown in the drawing, one embodiment of a lamp in accordance with this invention comprises an evacuated glass jacket 1 having the usual screw-type metal base 2 on one end. Disposed within jacket 1 is a ceramic arc tube 3 containing a fill including sodium and mercury. A metal rod 4 serves as a support for arc tube 1 as well as the electrical conductor to the upper electrode (not shown) within arc tube 3; rod 4 is electrically connected to one of the contacts on base 2, say, side contact 5. Bumpers 6 at the top and bottom of rod 4 bear against the inner wall of jacket 1 and help support the arc tube assembly. Support wire 7 is insulatively supported in glass stem mount 9 and supports the lower end of arc tube 3. Lead-in wire 8 is the electrical conductor from center contact 10 of base 2 to the lower electrode (not shown) within arc tube 3. Barium ring type getters 11 are disposed in the lower end of jacket 1 and deposit 12 of flashed barium is on the lower inner wall of jacket 1.

In order to determine if the barium film is spaced far enough away from the arc tube, the following test is made. A positive bias is applied to lead-in wire 8, thereby attracting any photoelectrons emitted by the barium film. The photocurrent resulting from the photoelectrons is then measured. The test can be performed in the following manner. The lamp is positioned vertically, base down, and 100 volts DC is applied to metal base 8, center contact 10 being positive with respect to side contact 5. This makes lead-in wire 8 positive relative to the barium film and will attract photoelectrons emitted therefrom. In order to induce photoelectron emission, a bright light is directed at the lower end of arc tube 3. For example, in one case, a 350 watt sungun lamp, spaced 90 cm from arc tube 3, was aimed through a lens about halfway in between so that a beam of light about 2 inches in diameter was focussed on the lower end of arc tube 2. This light would generate photoelectron emission from any barium that it impinged on. When the barium film is longitudinally more than about 1 cm from the end of arc tube 3, the photocurrent is less than about one nanoampere.

A comparison was made of two groups of lamps, the first group having a barium deposit 12 located further from arc tube 3 than the second group because of the angle at which getters 11 were mounted. In the first group, getters 11 were mounted at an angle of 45° relative to the lamp axis and were aimed towards the base of the lamp. In the second group getters 11 were mounted parallel to the lamp axis. After 3000 to 5000 hours of lamp operation, only 4% of the lamps in the first group showed sodium migration from arc tube 3 to jacket 1, while 68% of the lamps in the second group showed such sodium migration. Sodium migration is determined by analyzing the sodium D lines in the lamp spectral output in order to determine the percent of sodium in the lamp fill and comparing it with the percent of sodium in the original lamp fill.

It is generally not sufficient to merely adjust the angle of getters 11 in order to keep the barium film, comprising deposit 12 and invisible barium splash, more than 1 cm away from arc tube 3. For example, if getters 11 are positioned at 45° and are flashed by induction heat over the usual 2 to 3 second time interval, the barium splash can reach too high on the wall of jacket 1. We have found it preferable to position getters 11 at about 30° and to flash them over a 7–10 second time interval; this reduces the height of barium splash.

We claim:

1. A high pressure sodium arc discharge lamp comprising: an elongated arc tube disposed within an evacuated outer jacket, the arc tube containing a fill including sodium and mercury; one or more flash type barium getters disposed within said jacket; a barium film disposed on the inner wall of the jacket and longitudinally spaced more than 1 centimeter from the arc tube, the barium film comprising a visible barium deposit and an invisible barium splash.

2. The lamp of claim 1 wherein the jacket has a base at one end thereof and the barium film is at the base end of the jacket.

3. The lamp of claim 2 wherein the barium film is spaced more than 1 centimeter from a plane that is perpendicular to the arc tube and that passes through the end of the arc tube that is more proximate to said base.

4. The lamp of claim 1 wherein photoelectron current emitted by the barium film during normal lamp operation is insufficient to cause appreciable sodium migration from the arc tube during normal lamp life.

5. In the manufacture of a high pressure sodium arc discharge lamp, the steps comprising: disposing an elongated arc tube containing mercury and sodium in an outer jacket; disposing one or more flash type barium getters in the jacket; evacuating and sealing the jacket; and flashing the getter to form a barium film on the envelope, the film being longitudinally spaced more than 1 centimeter from the end of the arc tube.

6. The process of claim 5 wherein the barium film comprises a visible barium deposit and an invisible barium splash.

7. The process of claim 6 wherein the barium getter is positioned at such an angle and flashed under such conditions that barium splash on the envelope wall is longitudinally spaced more than 1 centimeter away from the end of the arc tube.

* * * * *